US006520254B2

(12) United States Patent
Hurst et al.

(10) Patent No.: US 6,520,254 B2
(45) Date of Patent: Feb. 18, 2003

(54) APPARATUS AND METHOD PROVIDING ALTERNATE FLUID FLOWPATH FOR GRAVEL PACK COMPLETION

(75) Inventors: Gary D. Hurst, Lake Jackson, TX (US); Raymond J. Tibbles, Missouri City, TX (US)

(73) Assignee: Schlumberger Technology Corporation, Rosharon, TX (US)

( * ) Notice: Subject to any disclaimer, the term of this patent is extended or adjusted under 35 U.S.C. 154(b) by 0 days.

(21) Appl. No.: 09/747,543

(22) Filed: Dec. 22, 2000

(65) Prior Publication Data

US 2002/0079099 A1 Jun. 27, 2002

(51) Int. Cl.[7] ..... E21B 43/04; E21B 43/08

(52) U.S. Cl. ..... 166/278; 166/233; 166/235; 166/51

(58) Field of Search ..... 166/278, 51, 227, 166/230, 233, 235

(56) References Cited

U.S. PATENT DOCUMENTS

| | | | | | |
|---|---|---|---|---|---|
| 5,333,688 | A | * | 8/1994 | Jones et al. | 166/235 |
| 5,417,284 | A | | 5/1995 | Jones | 166/280 |
| 5,419,394 | A | * | 5/1995 | Jones | 166/233 |
| 5,435,391 | A | | 7/1995 | Jones | 166/308 |
| 5,476,143 | A | * | 12/1995 | Sparlin et al. | 166/233 |
| 5,560,427 | A | | 10/1996 | Jones | 166/280 |
| 5,624,560 | A | * | 4/1997 | Voll et al. | 166/230 |
| 5,690,175 | A | | 11/1997 | Jones | 166/278 |
| 5,848,645 | A | | 12/1998 | Jones | 166/280 |
| 5,868,200 | A | * | 2/1999 | Bryant et al. | 166/242.3 |
| 6,125,932 | A | * | 10/2000 | Hamid et al. | 166/233 |
| 6,220,345 | B1 | * | 4/2001 | Jones et al. | 166/233 |
| 6,298,916 | B1 | * | 10/2001 | Tibbles et al. | 166/145 |
| 6,343,651 | B1 | * | 2/2002 | Bixenman | 166/205 |
| 2001/0047867 | A1 | * | 12/2001 | Bissonnette et al. | 166/278 |

FOREIGN PATENT DOCUMENTS

| | | | |
|---|---|---|---|
| WO | WO99/53172 | 10/1999 | E21B/43/119 |

OTHER PUBLICATIONS

Web page—http://www.johnsonscreens.com/p_super-flo.asp (undated).
Web page—http://www.johnsonscreens.com/p$_{13}$thin_pack.asp (undated).
Web page—http://www.johnsonscreens.com/p_escelflo.asp (undated).
Web page—http://www.johnsonscreens.com/sc_welded.asp (undated).
Web page—http://www.johnsonscreens.com/p_ultra.asp (undated).
Web page—http://www.johnsonscreens.com/p_super_weld.asp (undated).

* cited by examiner

*Primary Examiner*—David Bagnell
*Assistant Examiner*—Jennifer H Gay

(57) ABSTRACT

Apparatus and methods for use in completing a subterranean zone penetrated by a wellbore include a tubular member having a first segment and a second segment, each segment containing a longitudinal bore. The tubular member forms an annulus between itself and the wellbore wall. At least one screen member at least partially encloses and is coupled to a second segment of the tubular member. The screen member and the enclosed second segment of the tubular member both have openings that allow fluid communication between the longitudinal bore of the tubular member and the wellbore. The apparatus includes an alternate flowpath member having a wall, upper and lower ends, and at least one aperture in its wall. The apertures are small enough to substantially prevent passage of particulate material. The alternate flowpath member extends longitudinally along a portion of the wellbore and creates a communication path for fluid flow.

44 Claims, 5 Drawing Sheets

APPARATUS AND METHOD PROVIDING ALTERNATE FLUID FLOWPATH FOR GRAVEL PACK COMPLETION

BACKGROUND OF THE INVENTION

1. Field of the Invention

This invention relates generally to tools used to complete subterranean wells and more particularly to apparatus and methods used in gravel pack operations.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sand or silt flowing into the wellbore from unconsolidated formations can lead to an accumulation of fill within the wellbore, reduced production rates and damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The problems caused by sand production can significantly increase operational and maintenance expenses and can lead to a total loss of the well.

One means of controlling sand production is the placement of relatively large grain sand (i.e., "gravel") around the exterior of a slotted, perforated, or other type liner or screen. The gravel serves as a filter to help assure that formation fines and sand do not migrate with the produced fluids into the wellbore. In a typical gravel pack completion, a screen is placed in the wellbore and positioned within the unconsolidated formation that is to be completed for production. The screen is typically connected to a tool that includes a production packer and a cross-over, and the tool is in turn connected to a work or production tubing string. The gravel is mixed with a carrier fluid and pumped in a slurry down the tubing and through the cross-over, thereby flowing into the annulus between the screen and the wellbore. The carrier fluid in the slurry leaks off into the formation and/or through the screen. The screen is designed to prevent the gravel in the slurry from flowing through it and entering into the production tubing. As a result, the gravel is deposited in the annulus around the screen where it forms a gravel pack. It is important to size the gravel for proper containment of the formation sand, and the screen must be designed in a manner to prevent the flow of the gravel through the screen.

In order for the gravel to be tightly packed within the annulus as desired, the carrier fluid must leave the slurry in a process called dehydration. For proper dehydration, there must be paths for the fluid to exit the slurry. Dehydration of the slurry can be difficult to achieve in areas of the annulus that are not adjacent to a fluid path such as a gravel pack screen or perforations into a permeable formation. In areas where there is inadequate dehydration, the carrier fluid restricts the packing of the gravel and can lead to voids within the gravel pack. Sections of wellbore located between gravel pack screens are areas where it is difficult to achieve a gravel pack. The area of the wellbore below the lowest perforated zone is another location that can lead to voids within the gravel packed annulus. Over time the gravel that is deposited within the annulus may have a tendency to settle and fill any void areas, thereby loosening the gravel pack that is located higher up in the wellbore, and potentially creating new voids in areas adjacent to producing formations.

Once the well is placed on production, the flow of produced fluids will be concentrated through any voids that are present in the gravel pack. This can cause the flow of fines and sand from the formation with the produced fluids and can lead to the many problems discussed above.

There is a need for improved tools and methods to improve slurry dehydration and to minimize the creation of voids during a gravel pack completion of a wellbore.

SUMMARY OF THE INVENTION

The present invention provides improved apparatus and methods for use in completing a subterranean zone penetrated by a wellbore.

One aspect of the invention is an apparatus comprising a tubular member having a first segment and a second segment, each segment containing a longitudinal bore. The tubular member forms an annulus between itself and the wellbore wall. The first segment comprises the portion of the tubular member that does not contain apertures to allow fluid communication between the bore of the tubular member and the wellbore. The second segment comprises the portion of the tubular member that contains apertures to allow fluid communication between the bore of the tubular member and the wellbore. At least one screen member at least partially encloses and is coupled to a second segment of the tubular member. The screen member and the enclosed second segment of the tubular member both have openings that allow fluid communication between the longitudinal bore of the tubular member and the wellbore. The apparatus includes an alternate flowpath member having a wall, upper and lower ends, and at least one aperture in its wall. The apertures are small enough to substantially prevent the passage of particulate material from going through. The alternate flowpath member extends longitudinally along a portion of the wellbore and creates a communication path for fluid flow.

In alternate embodiments, the alternate flowpath member can be sealed on the upper end or can be sealed on both the upper and lower ends. The alternate flowpath member can also be attached to the exterior of the tubular member.

The apparatus can further comprise a plurality of screen members and second segments spaced longitudinally on the tubular member. It can likewise comprise a plurality of first segments.

In alternate embodiments of the invention, the alternate flowpath member can extend below the lowest screen member, can extend between two separate screen members, or can alternately extend between two separate first segments of the tubular member. In another embodiment the alternate flowpath member can extend at least from the uppermost screen member to below the lowest screen member. In yet another embodiment the alternate flowpath member can extend at least from the uppermost screen member to the lowest first segment of the tubular member. In still another embodiment the alternate flowpath member can comprise a slotted tubular that is sealed on both ends.

One embodiment of the present invention includes the screen members and first segments of the tubular member each forming an annulus between themselves and the wellbore wall. The alternate flowpath member can be attached to the tubular member. The alternate flowpath member can provide fluid communication between the annulus adjacent to a screen member and the annulus adjacent to another screen member. The alternate flowpath member can likewise provide fluid communication between the annulus adjacent to a screen member and the annulus adjacent to a first segment of the tubular member.

The wellbore can comprise a well casing disposed within the wellbore, the well casing comprising a perforated section and a non-perforated section. The perforated section provides fluid communication between the subterranean zone and the wellbore. The wellbore can comprise a plurality of perforated sections and non-perforated sections.

In one embodiment of the invention the alternate flowpath member extends from a perforated section of casing to a non-perforated section of casing. In another embodiment the alternate flowpath member extends at least from one perforated section of casing to another perforated section of casing. In yet another embodiment the alternate flowpath member extends at least from the lowest perforated section of casing to the lowest non-perforated section of casing. In still another embodiment the alternate flowpath member extends from above the highest perforated section of casing to the lowest non-perforated section of casing.

One embodiment of the present invention comprises a production string having at least one sand screen and an alternate flowpath member positioned outside the production string providing fluid communication substantially longitudinally with respect to the production string. The alternate flowpath member can be adapted to prevent the flow of a gravel particulate therethrough.

The alternate flowpath member can be a conduit. The alternate flowpath member can comprise apertures such as slots, small holes or a screen element that allow fluid to pass through but that are small enough to prevent the passage of a gravel particulate.

The alternate flowpath member can be positioned at least partially longitudinally offset from the sand screen. It can be positioned between adjacent sand screens, and can overlap the adjacent sand screens. The alternate flowpath member can also extend below the lowest sand screen.

The well completion can further comprise a completion zone, where the alternate flowpath extends substantially the length of the completion zone. It can also comprise where the alternate flowpath member is incorporated within the sand screens. The well completion can further comprise a protective shroud. The alternate flowpath member can be attached to the production string.

Yet another embodiment is a well completion comprising a production string having at least one sand screen and an alternate flowpath member that is attached to and positioned outside the production string comprising a conduit containing at least one aperture. The conduit apertures are sized to substantially prevent the flow of gravel particulates while providing fluid communication. The conduit is positioned to provide a fluid flowpath between one or more locations adjacent the production string without a sand screen and an area adjacent the production string having a sand screen.

Still another embodiment is an alternate flowpath member for use in a well comprising a conduit defining a passageway extending at least partially longitudinally therethrough, with at least one port through a wall of the conduit providing fluid communication into and from the conduit at two or more longitudinal locations on the conduit. The ports are adapted to prevent the flow of gravel particulates therethrough and an attachment is adapted to connect the conduit to a well production conduit. The alternate flowpath member can further comprise a screening element applied to the ports to prevent the flow of gravel particulates through the ports. The screening element can comprise a wire wrap, mesh, screen, or filter mechanism.

Another aspect of the present invention is a method for completing a well that comprises positioning a production string in a well, the production string having at least one sand screen positioned to receive fluid therethrough and providing an alternate flowpath outside the production string that provides fluid communication substantially longitudinally with respect to the production string. Fluid slurry containing gravel is injected down through the well to gravel pack an annulus formed outside the sand screen. The alternate flowpath is sized so as to substantially prevent the flow of the gravel through it.

A further embodiment is a method for creating alternate flowpaths that comprises providing a conduit having a longitudinal passageway and providing one or more flow ports between an exterior of the conduit and the passageway. A barrier is created to the flow of gravel through the passageway and the conduit is attached to a production conduit. The flow ports are sized to prevent the flow of gravel therethrough. A screen element can be included that prevents the flow of gravel through the flow ports.

Another embodiment of the present invention is a method for completing a subterranean zone penetrated by a wellbore having a wall. This method comprises the steps of providing an apparatus as described above. This apparatus is placed within the wellbore to be completed and a slurry comprising particulate material flows into the annulus area between the wellbore wall and the tubular member. In this way the particulate material is placed within the annulus between the wellbore wall and the tubular member. The alternate flowpath member provides a fluid path for the slurry dehydration.

The method can further comprise the step of attaching the apparatus to a packer and a cross-over tool, prior to positioning the apparatus within the wellbore.

The method can also comprise the step of setting the packer and flowing a slurry comprising particulate material through the packer and cross-over tool into the annulus between the wellbore wall and the tubular member. In this way the particulate material is placed within the annulus between the wellbore wall and the tubular member.

DESCRIPTION OF ILLUSTRATIVE EMBODIMENTS

Figure 1:
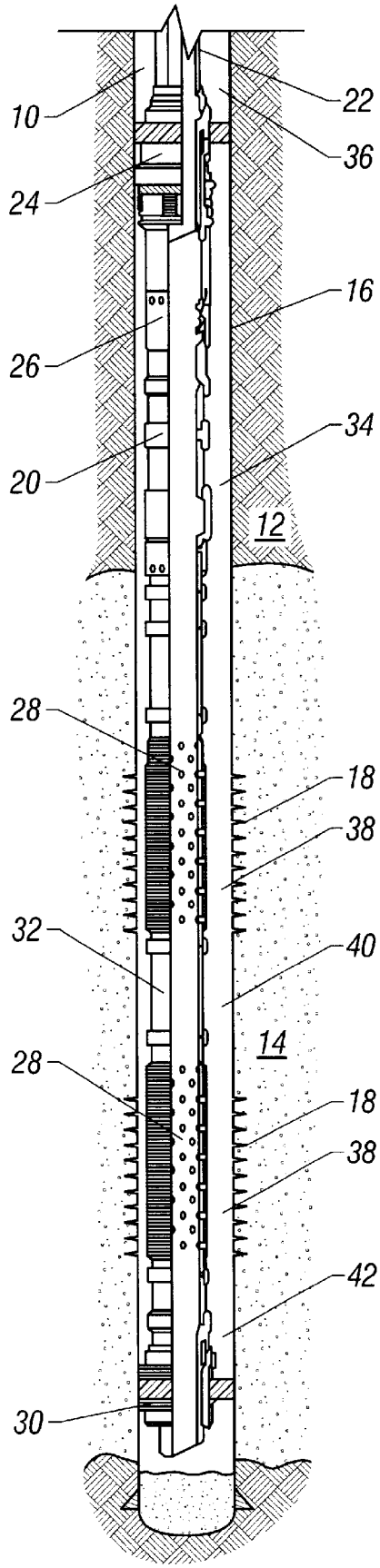
FIG. 1 (Prior Art)
FIG. 1 is a cross section of a wellbore showing a typical gravel pack completion apparatus. This illustration is of prior art.

Referring to the attached drawings, FIG. 1 illustrates a wellbore 10 that has penetrated a subterranean zone 12 that includes a productive formation 14. The wellbore 10 has a casing 16 that has been cemented in place. The casing 16 has a plurality of perforations 18 which allow fluid communication between the wellbore 10 and the productive formation 14. A well tool 20 is positioned within the casing 16 in a position adjacent to the productive formation 14, which is to be gravel packed.

The well tool 20 comprises a tubular member 22 attached to a production packer 24, a cross-over 26, one or more screen elements 28 and optionally a lower packer 30. Blank sections 32 of pipe may be used to properly space the relative positions of each of the components. An annulus area 34 is created between each of the components and the wellbore casing 16. The combination of the well tool 20 and the tubular string extending from the well tool to the surface can be referred to as the production string.

In a gravel pack operation the packer elements 24, 30 are set to ensure a seal between the tubular member 22 and the casing 16. Gravel laden slurry is pumped down the tubular member 22, exits the tubular member through ports in the cross-over 26 and enters the annulus area 34. In one typical embodiment the particulate matter (gravel) in the slurry has an average particle size between about 40/60 mesh–12/20 mesh, although other sizes may be used. Slurry dehydration occurs when the carrier fluid leaves the slurry. The carrier fluid can leave the slurry by way of the perforations 18 and enter the formation 14. The carrier fluid can also leave the slurry by way of the screen elements 28 and enter the tubular member 22. The carrier fluid flows up through the tubular member 22 until the cross-over 26 places it in the annulus area 36 above the production packer 24 where it can leave the wellbore 10 at the surface. Upon slurry dehydration the gravel grains should pack tightly together. The final gravel filled annulus area is referred to as a gravel pack.

As can be seen in FIG. 1, the annulus area 38 between the screen element 28 and the casing perforations 18 has multiple fluid flow paths for slurry dehydration. The annulus area 40 between a blank section 32 and unperforated casing does not have any direct fluid flow paths for slurry dehydration. If the blank section 32 extends more than a few feet in length, the slurry dehydration in the adjacent annulus area 40 can be greatly reduced and can lead to a void area within the resulting gravel pack.

An area that is prone to developing a void during a gravel pack operation is the annulus area 42 below the lowest screen element 28, sometimes referred to as the "sump". A gravel pack void in the sump is particularly problematic in that it can allow the gravel from above to settle and fall into the voided sump. Production of fluids from the productive formation 14 can agitate or "fluff" the gravel pack and initiate the gravel to migrate and settle within the sump 42. This can lead to the creation of voids in the annulus areas 38 adjacent to the screen elements 28 and undermine the effectiveness of the entire well completion.

The area from the top perforation to the lowest perforation can be referred to as a completion zone. For a good gravel pack completion the entire completion zone should be tightly packed with gravel and contain no void areas.

As used herein, the term "screen" refers to wire wrapped screens, mechanical type screens and other filtering mechanisms typically employed with sand screens. Sand screens need to be have openings small enough to restrict gravel flow, often having gaps in the 60–120 mesh range, but other sizes may be used. The screen element 28 can be referred to as a sand screen. Screens of various types are produced by US Filter/Johnson Screen, among others, and are commonly known to those skilled in the art.

Figure 2:
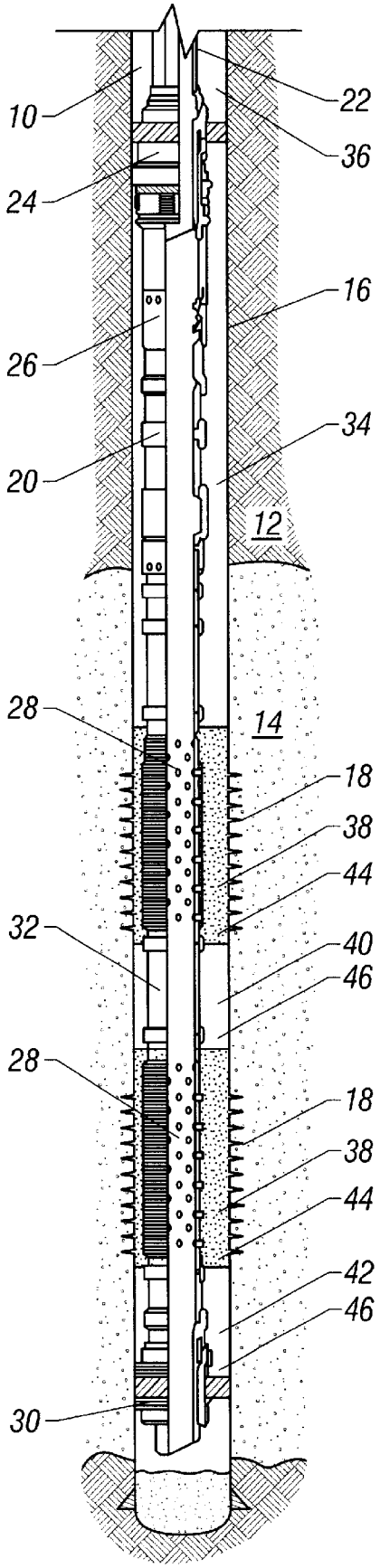
FIG. 2 (Prior Art)
FIG. 2 is a cross section of a wellbore showing a typical gravel pack completion that experienced gravel bridging. This illustration is of prior art.

FIG. 2 illustrates how gravel bridging 44 can occur in the annulus area 38 adjacent to a screen element 28. This gravel bridging can result in a void area 46 within the gravel pack as shown in the annulus areas 40, 42.

Figure 3:
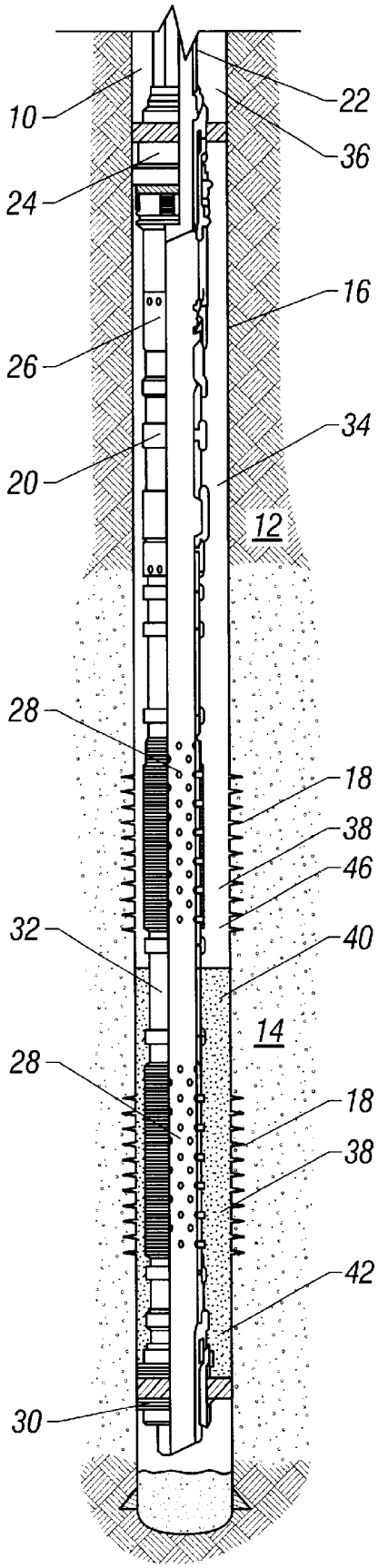
FIG. 3 (Prior Art)
FIG. 3 is a cross section of a wellbore showing a typical gravel pack completion that has experienced gravel bridging followed by gravel pack settling. This illustration is of prior art.

FIG. 3 illustrates the result of gravel settling within the gravel pack. As the gravel has settled within the wellbore 10, a void area 46 within the gravel pack has developed within the annulus area 38 adjacent to the upper screen element 28. This void area 46 now enables direct flow from the productive formation 14 to the screen element 28 and the tubular member 22, defeating the purpose of conducting the gravel pack completion.

Figure 4:
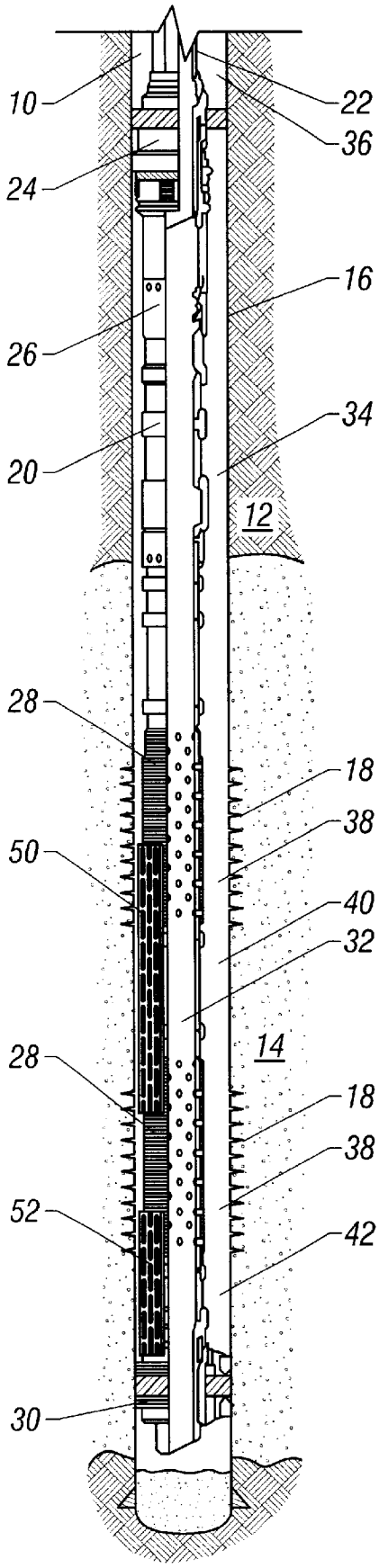
FIG. 4 is a cross section of a wellbore showing a gravel pack completion apparatus utilizing the present invention.

Referring to FIG. 4, the present invention involves a wellbore 10 that has penetrated a subterranean zone 12 that includes a productive formation 14. The wellbore 10 has a casing 16 that has been cemented in place. The casing 16 has a plurality of perforations 18 which allow fluid communication between the wellbore 10 and the productive formation 14. A well tool 20 is positioned within the casing 16 in a location adjacent to a productive formation 14 that is to be gravel packed.

The well tool 20 comprises a tubular member 22 attached to a production packer 24, a cross-over 26, one or more screen elements 28 and optionally a lower packer 30. Blank sections 32 of pipe may be used to properly space the relative positions of each of the components. An annulus area 34 is created between each of the components and the wellbore casing 16.

Alternate flowpath elements 50, 52 are placed within the annulus areas where additional fluid flowpaths are needed for slurry dehydration. The upper alternate flowpath element 50 extends across a blank section 32 located between two screen elements 28. The blank section 32 is referred to herein as a first segment of the tubular member and the perforated portion of the tubular member that is covered by the screen element 28 is referred to herein as the second segment. This upper alternate flowpath element 50 provides a fluid flow path for slurry dehydration between the annulus area 40 adjacent to the blank section 32 and the annulus area 38 adjacent to the screen element 28. This additional fluid flow path minimizes the tendency for voids to develop within the gravel pack at these locations.

In FIG. 4, the lower alternate flowpath element 52 extends from the annulus area 38 adjacent to the screen element 28 to the annulus area 42 adjacent to the lowest blank section 32. This alternate flowpath element 52 provides a fluid flow path for slurry dehydration within the sump area 42, which facilitates a proper gravel pack free of voids, within the annulus areas where the alternate flowpath element 52 is located. The alternate flowpath element 52 allows fluid communication along its length through the apertures in its wall. These apertures are sized so as to allow passage of fluids but restrict passage of the gravel. The apertures will typically have openings in the 4–24 mesh range, but other sizes may be used. The alternate flowpath element therefore facilitates the dehydration of the gravel laden slurry by providing a fluid path while restricting any gravel flow. Embodiments of the alternate flowpath element can be in the form of conduits that contain apertures in the form of slots, holes, wire wrap, mesh, screen or filter elements. An example of wire wrap, mesh screen and prepacked screen tubulars that are commonly used in oil and gas wells are those produced by US Filter/Johnson Screens.

A few embodiments of the alternate flowpath element are illustrated in FIGS. 5A–5D. It should be realized that these are not intended to be comprehensive and that other embodiments are possible.

Figure 5B:
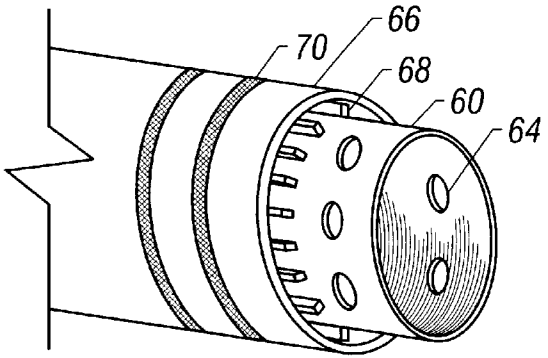
FIGS. 5A–5D show possible embodiments of the alternate flowpath element.
Figure 5D:
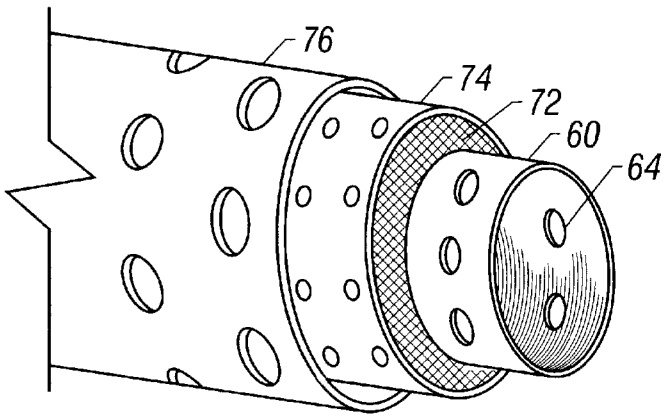
Figure 5A:
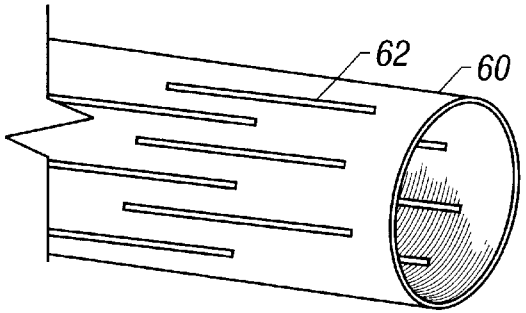

FIG. 5A illustrates a conduit 60 comprising apertures in the form of slots 62. The slots 62 are sized so that they act as the screening mechanism that allows fluid to pass but restricts the passage of the gravel.

FIG. 5B shows a conduit 60 comprising apertures in the form of holes 64. The holes 64 are too large to act as the screening mechanism so this embodiment includes a wire wrap 66 that is attached to the outside of the conduit 60. The wire wrap 66 is spaced away from the conduit 60 by means of longitudinal rods 68 that provide an annulus area between the wire wrap 66 and the conduit 60 to allow fluid flow. The wire wrap 66 is spaced so as to provide a known gap 70 between the adjacent wraps that will provide the screening mechanism desired.

Figure 5C:
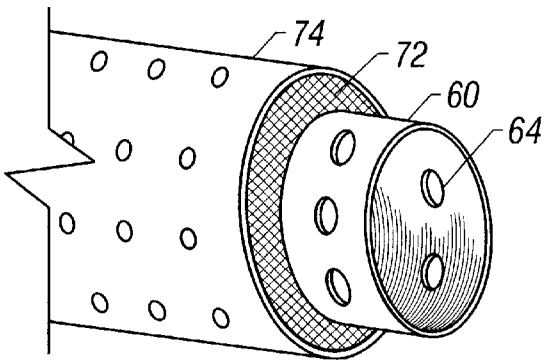

FIG. 5C shows a conduit 60 with holes 64 and a mesh element 72. The mesh element provides the desired screening mechanism. A perforated protective cover 74 is applied to secure the mesh element 72 and provide a suitable exterior surface.

FIG. 5D illustrates the embodiment of FIG. 5C with the addition of a protective shroud 76. The protective shroud 76 is designed to protect the alternate flowpath element from damage while being inserted into the wellbore and while in service. The protective shroud 76 is shown having perforations so as to not restrict fluid flow.

Figure 6:
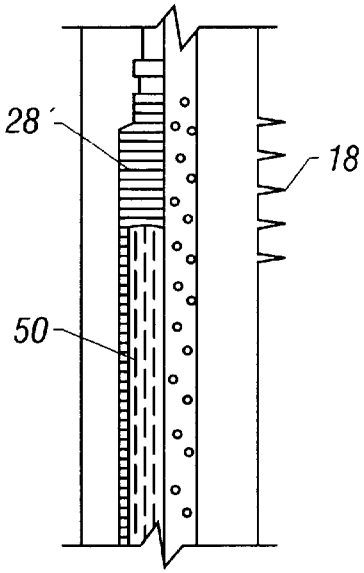
FIG. 6 shows an embodiment in which an alternate flowpath is incorporated within a screen.

For ease of installation and to ensure proper placement relative to the components of the well tool 20, the alternate flowpath elements 50,52 will typically be attached to the exterior of the well tool 20 in some manner, such as by welding. It is also possible for the alternate flowpath elements to be incorporated within the screen elements 28, such as the alternate flowpath element 50 being incorporated within the screen element 28' shown in FIG. 6. The screen element 28' can have a larger diameter than the blank sections 32 located between them. The alternate flowpath elements could then be incorporated within the screen elements 28', extending longitudinally between the screen elements 28' and radially offset from the blank section 32 located between the screen elements 28'. This would essentially connect the screen elements 28' and provide a dehydration fluid flow path in the annulus area 40 adjacent the blank section 32.

As used herein the term of first segment is used to refer to a blank section of the tubular member and the term of second segment is used to refer to a section of the tubular member that has apertures. It is possible to have a plurality of either first or second segments, in fact the typical gravel pack completion will comprise a plurality of both first and second segments.

In the gravel pack operation the packer elements 24, 30 are set to ensure a seal between the tubular member 22 and the casing 16. Gravel laden slurry is pumped down the tubular member 22, exits the tubular member through ports in the cross-over 26 and enters the annulus area 34. Slurry dehydration occurs when the carrier fluid leaves the slurry. The carrier fluid can leave the slurry by way of the screen elements 28 and enter the tubular member 22. The carrier fluid flows up through the tubular member 22 until the cross-over 26 places it in the annulus area 36 above the production packer 24 where it can leave the wellbore 10 at the surface. Slurry located within the annulus area 40 adjacent to a blank section 32 of the tubular member is prone to inadequate slurry dehydration. The areas that are prone to gravel pack voids can now be dehydrated utilizing the alternate flowpath member 50. The slurry carrier fluid can leave the slurry, enter the alternate flowpath member 50, and travel to an annulus area 38 adjacent to a screen element 28. Slurry located within the sump area 42 can likewise be dehydrated utilizing the alternate flowpath member 52 that can transport the carrier fluid from the sump area 42 to an annulus area 38 adjacent to a screen element 28 where the carrier fluid can enter the tubular member 22 and be circulated out of the wellbore 10. Upon slurry dehydration the gravel grains should pack tightly together. The final gravel filled annulus area is referred to as a gravel pack.

The discussion and illustrations within this application refer to a vertical wellbore that has casing cemented in place and comprises casing perforations to enable communication between the wellbore and the productive formation. The present invention can also be utilized to complete wells that are not cased and likewise to wellbores that have an orientation that is deviated from vertical.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus for completing a subterranean zone penetrated by a wellbore, the wellbore having a wall, comprising:

a tubular member having a first segment and a second segment, each segment having a longitudinal bore therethrough, and the tubular member forming an annulus between the tubular member and the wellbore wall;

at least one screen member at least partially enclosing and coupled to the second segment of the tubular member, the screen member and the enclosed second segment of the tubular member both having openings allowing fluid communication between the longitudinal bore of the tubular member and the wellbore; and an alternate flowpath member having a wall with at least one aperture therein, an upper end, and a lower end, the at least on aperture being small enough to substantially prevent passage of particulate material therethrough, and the alternate flowpath member extending longitudinally along a portion of the wellbore creating a communication path for fluids.

2. The apparatus of claim 1, wherein the first segment does not comprise any apertures that would allow fluid communication between the tubular member longitudinal bore and the wellbore.

3. The apparatus of claim 1, wherein the alternate flowpath member comprises a slotted tubular.

4. The apparatus of claim 1, wherein the alternate flowpath member is attached to the exterior of the tubular member.

5. The apparatus of claim 1, comprising a plurality of screen members and second segments spaced longitudinally on the tubular member.

6. The apparatus of claim 5, wherein the alternate flowpath member extends below the lowest screen member.

7. The apparatus of claim 5, wherein the alternate flowpath member extends between two separate screen members.

8. The apparatus of claim 5, wherein the alternate flowpath member extends at least from the uppermost screen member to below the lowest screen member.

9. The apparatus of claim 1, comprising a plurality of first segments.

10. The apparatus of claim 9, wherein the alternate flowpath member extends between two separate first segments of the tubular member.

11. The apparatus of claim 1, comprising a plurality of first segments, a plurality of second segments, and a plurality of screen members.

12. The apparatus of claim 11, wherein the alternate flowpath member extends at least from the uppermost screen member to the lowest first segment of the tubular member.

13. The apparatus of claim 11, wherein the screen members and first segments of the tubular member each form an annulus between themselves and the wellbore wall.

14. The apparatus of claim 13, wherein the alternate flowpath member is attached to the tubular member and provides fluid communication between the annulus adjacent to a screen member and the annulus adjacent to another screen member.

15. The apparatus of claim 13, wherein the alternate flowpath member is attached to the tubular member and provides fluid communication between the annulus adjacent to a screen member and the annulus adjacent to a first segment of the tubular member.

16. The apparatus of claim 1, wherein the wellbore further comprises a well casing disposed within the wellbore, the well casing comprising a perforated section and a non-perforated section, the perforated section providing fluid communication between the subterranean zone and the wellbore.

17. The apparatus of claim 16, wherein the alternate flowpath member extends from the perforated section of casing to the non-perforated section of casing.

18. The apparatus of claim 16, wherein the well casing comprises a plurality of perforated sections and non-perforated sections.

19. The apparatus of claim 18, wherein the alternate flowpath member extends at least from one perforated section of casing to another perforated section of casing.

20. The apparatus of claim 18, wherein the alternate flowpath member extends at least from the lowest perforated section of casing to the lowest non-perforated section of casing.

21. The apparatus of claim 18, wherein the alternate flowpath member extends from above the highest perforated section of casing to the lowest non-perforated section of casing.

22. A well completion, comprising:

a production string having at least one sand screen;

an alternate flowpath member positioned outside the production string providing fluid communication substantially longitudinally with respect to the production string;

the alternate flowpath member adapted to prevent the flow of a gravel particulate therethrough.

23. The well completion of claim 22, wherein the alternate flowpath member comprises a conduit.

24. The well completion of claim 23, wherein the alternate flowpath member comprises at least one aperture such as slots, small holes or a screen element that allow fluid to pass through but are small enough to prevent the passage of a gravel particulate.

25. The well completion of claim 24, wherein the alternate flowpath member is attached to the production string.

26. The well completion of claim 23, wherein the alternate flowpath member is positioned at least partially longitudinally offset from the sand screen.

27. The well completion of claim 23, wherein at least a portion of the alternate flowpath member is positioned between adjacent sand screens.

28. The well completion of claim 27, wherein the alternate flowpath member overlaps the adjacent sand screens.

29. The well completion of claim 23, further comprising a completion zone, wherein the alternate flowpath member extends substantially the length of the completion zone.

30. The well completion of claim 23, wherein the production string further comprises another sand screen that is a lowest screen, and wherein the alternate flowpath member extends below the lowest sand screen.

31. The well completion of claim 22, wherein the alternate flowpath member is incorporated within the sand screens.

32. The well completion of claim 22, further comprising a protective shroud for the alternate flowpath member.

33. A well completion, comprising:

a production string having at least one sand screen;

an alternate flowpath member attached to and positioned outside the production string comprising a conduit containing at least one aperture;

wherein the at least one conduit aperture is sized to prevent the flow of a gravel particulate therethrough while providing fluid communication therethrough; and wherein the conduit is positioned to provide a fluid flowpath between one or more locations adjacent the production string not having a sand screen and an area adjacent the production string having a sand screen.

34. An alternate flowpath for use in a well, comprising:

a conduit defining a passageway extending at least partially longitudinally therethrough;

at least one port through a wall of the conduit providing fluid communication into and from the conduit at at least two longitudinal locations on the conduit;

the at least one port adapted to prevent the flow of gravel particulates therethrouh;

an attachment adapted to connect the conduit to a well production conduit.

35. The alternate flowpath of claim 34, further comprising a screening element applied to the at least one port.

36. The alternate flowpath of claim 35, wherein the screening element comprises a wire wrap, mesh, screen, or filter mechanism.

37. A method for comprising a well, comprising:

(a) positioning a production string in the well, the production string having at least one sand screen positioned to receive fluid therethrough;

(b) providing an alternate flowpath outside the production string that provides fluid communication substantially with respect to the production string;

(c) injecting a fluid slurry containing gravel down through the well to gravel pack an annulus formed outside the sand screen; and (d) sizing at least a portion of the alternate flowpath member to prevent the flow of the gravel therethrough.

38. A method for creating alternate flowpaths, comprising:

(a) providing a conduit having a longitudinal passageway;

(b) providing one or more flow ports between an exterior of the conduit and the passageway;

(c) creating a barrier to the flow of gravel through the passageway; and (d) attaching the conduit to a production conduit.

39. The method of claim 38, further comprising sizing the flow ports to substantially prevent the flow of gravel therethrough.

40. The method of claim 38, further comprising providing a screen element that substantially prevents the flow of gravel through the flow ports.

41. A method for completing a subterranean zone penetrated by a wellbore having a wall, comprising the steps of:

(a) providing an apparatus comprising: (i) a tubular member having a first segment and a second segment, each segment having a longitudinally bore therethrough, and the tubular member forming an annulus between the tubular member and the wellbore wall, (ii) at least one screen member enclosing and coupled to the second segment of the tubular member, the screen member and the enclosed second segment of the tubular member both having openings allowing communication between the longitudinal bore of the tubular member and the wellbore, and (iii) an alternate flowpath member having at least one aperture, the at least one aperture being small enough to substantially prevent passage of particulate material therethrough and the alternate flowpath member extending longitudinally along a portion of the wellbore creating a communication path for fluids;

(b) positioning the apparatus within the wellbore to be completed; and (c) flowing a slurry comprising particulate material into the annulus between the wellbore wall and the tubular member, whereby the particulate material is placed within the annulus between the wellbore wall and the tubular member, and whereby the alternate flowpath member provides a fluid path for slurry dehydration.

42. The method of claim 41, further comprising the step of attaching the apparatus to a packer and a cross-over tool, prior to positioning the apparatus within the wellbore.

43. The method of claim 42, further comprising the step of setting the packer and flowing the slurry comprising particulate material through the packer and cross-over tool into the annulus between the wellbore wall and the tubular member, whereby the particulate material is placed within the annulus between the wellbore wall and the tubular member.

44. The method of claim 41, whereby during the dehydration of the slurry a portion of the carrier fluid leaves the slurry and flows through the alternate flowpath member.

* * * * *